United States Patent [19]

Silgailis et al.

[11] Patent Number: 4,668,309

[45] Date of Patent: May 26, 1987

[54] RAPID MAGNETIC ANNEALING OF AMORPHOUS METAL IN MOLTEN TIN

[75] Inventors: John Silgailis, Cedar Grove; Davidson M. Nathasingh, Stanhope; Christopher A. Bruckner, Madison, all of N.J.

[73] Assignee: Allied Corporation, Morris Township, Morris County, N.J.

[21] Appl. No.: 871,955

[22] Filed: Jun. 9, 1986

[51] Int. Cl.[4] ..... C21D 1/04

[52] U.S. Cl. ..... 148/108; 148/122

[58] Field of Search ..... 148/108, 122, 15, 20

[56] References Cited

U.S. PATENT DOCUMENTS 4,081,298 3/1978 Mendelsohn et al. ..... 148/108
4,355,221 10/1982 Lin ..... 148/108

FOREIGN PATENT DOCUMENTS 59-41457 3/1984 Japan ..... 148/122
59-177353 10/1984 Japan ..... 148/108
225405 11/1985 Japan .

OTHER PUBLICATIONS

B. S. Berry et al., Phys. Rev. Lett. 34, 1022 (1975).
*The Making, Shaping and Treating of Steel,* A.I.S.E., 10th ed., 1985, p. 998.

*Primary Examiner*—John P. Sheehan
*Attorney, Agent, or Firm*—James Riesenfeld

[57] ABSTRACT

A method of rapidly annealing an amorphous metal core consists of applying a magnetic field to the core, immersing the core in a hot liquid for a period of time, and then placing the core in a cooling fluid. The hot liquid is preferably a molten metal or molten metal alloy, such as molten tin or solder. The cooling fluid may be an organic liquid or liquefied gas. Rapid magnetic annealing provides advantages not only of less time and energy costs, but also yields an annealed core that is more ductile than those of the prior art. The greater ductility permits a wound core to be annealed by this method and then rewound into another core.

17 Claims, 6 Drawing Figures

RAPID MAGNETIC ANNEALING OF AMORPHOUS METAL IN MOLTEN TIN

BACKGROUND OF THE INVENTION

1. Field of the Invention

This invention relates to a method for rapidly annealing amorphous metal by first immersing it in molten tin and then in a cooling fluid.

2. Description of the Prior Art

It has been known for over a decade that the soft magnetic properties of an amorphous metal alloy can be improved by magnetic annealing. See, e.g., B. S. Berry et al., Phys. Rev. Lett. 34, 1022 (1975) and F. E. Luborsky et al., IEEE Trans. Magn. MAG II, 1644 (1975). For transformer core applications, magnetic annealing—heating the core in the presence of an applied magnetic field—reduces the coercive force and induces uniaxial anisotropy, while reducing the stress introduced during the ribbon casting and core winding processes In the past, magnetic annealing was accomplished in ovens, and anneal times of several hours were required. Besides the time and energy costs involved in the conventional annealing process, an additional drawback is the fact that the alloy becomes brittle during annealing.

Annealing steel wire in molten lead is disclosed in *The Making, Shaping and Treating of Steel,* A.I.S.E., 10th ed., 1985, p. 998.

SUMMARY OF THE INVENTION

In accordance with the present invention, a method for rapidly annealing an amorphous metal alloy core comprises the steps of (a) applying a magnetic field to the core, (b) immersing the core in a liquid comprising molten tin, whose temperature is in the range between about 0.6 $T_g$ and 1.0 $T_g$, where $T_g$ is the glass transition temperature of the alloy in degrees C., (c) separating the core from the liquid, and (d) immersing the core in a cooling fluid.

Preferably, the core is coated or wrapped before it is immersed in the liquid to prevent the liquid from contaminating, adhering to, or seeping into the laminations of the core.

The core that results from the present method has equivalent magnetic properties and higher ductility than cores annealed by prior art methods.

DETAILED DESCRIPTION OF THE INVENTION

Figure 1A:
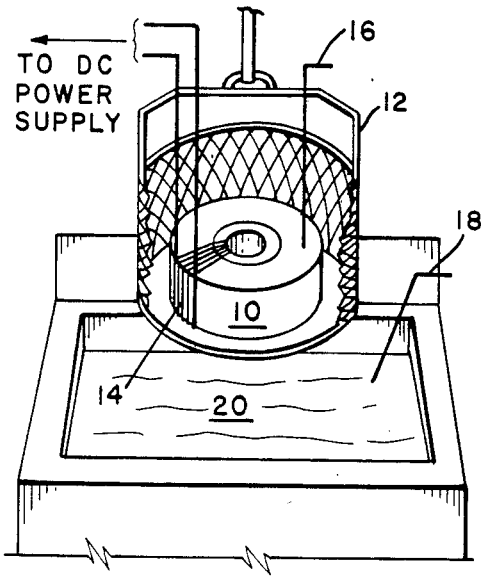
FIGS. 1A to 1D are schematic of an embodiment of the method of the present invention.
Figure 1B:
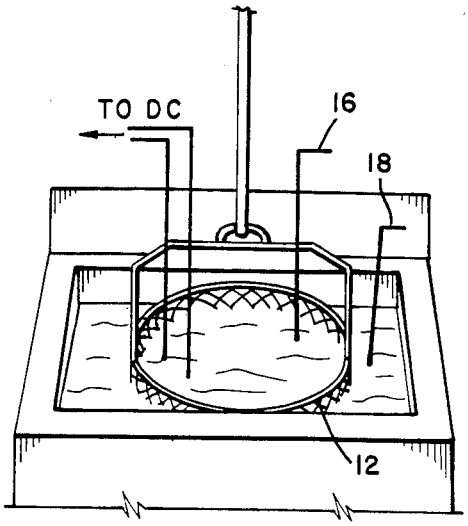
Figure 1C:
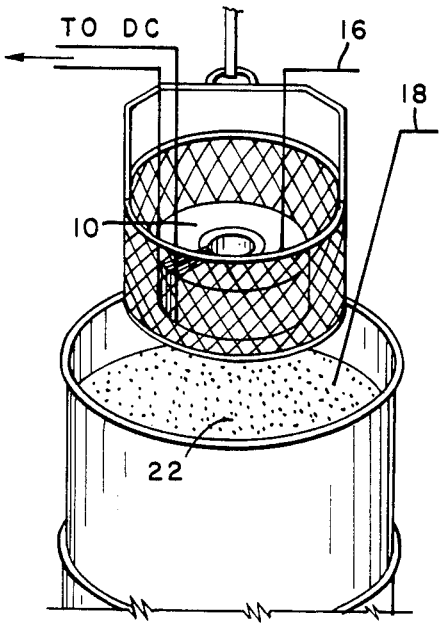
Figure 1D:
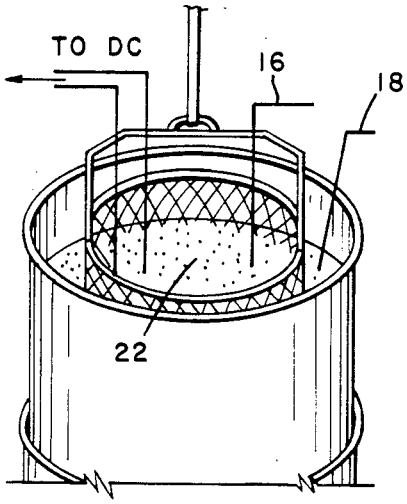

Amorphous metal alloys are formed when certain compositions are cooled very rapidly, typically, about $10^6$ °C./s. Among alloys that can be solidified in amorphous form are ferromagnetic alloys, generally Fe-,Ni-, or Co- based, sometimes including two or more of these transition metal elements. Their soft magnetic properties make amorphous metal alloys well-suited for use in transformer cores. Compared with as-cast ribbon, these soft magnetic properties can be enhanced by annealing the ribbon or core in an applied magnetic field at a temperature below $T_C$, the Curie temperature. The improved magnetic properties—lower coercivity, uniaxial magnetic anisotropy—that result from this magnetic annealing process have generally been accompanied by reduced ductility. In comparison with as-cast ribbon, which can be quite ductile and windable, annealed material is brittle and, thus, less convenient to use in applications that require winding. The present invention provides a method of steering between the disadvantages of sub-optimum magnetic properties and reduced ductility by accomplishing magnetic annealing rapidly, thereby reducing time and energy costs as well.

FIG. 1 is a schematic representation of the method of the present invention. In FIG. 1A core 10 is supported in container 12, which is partially cut away. Windings 14, powered by a supply not shown, generate a magnetic field in core 10. Optional thermocouples 16 and 18 monitor the temperatures at the center of core 10 and in hot liquid 20, respectively. In FIG. 1B the core is being magnetically annealed in hot liquid 20. In FIG. 1C the core, having completed the first part of the anneal, is shown above cooling fluid 22, and in FIG. 1D the core is immersed in cooling fluid 22.

In principle, any material that is liquid at the required annealing temperature (in the range from about 320°-535° C.) is suitable for the hot liquid. Commonly available low-melting metals or metal alloys used in solder are preferred, because they are readily available. Liquids comprising molten tin are particularly preferred, because of their low vapor pressure and relative lack of environmental problems, compared with mixtures that contain lead, for example. Depending on the density of the core and hot liquid, the core may tend to float in the liquid, in which case a force is applied to the core to submerge it in the liquid.

Any magnetic amorphous metal alloy composition may be used to form the core. Typically, the alloy is prepared in the form of a filament or ribbon, then spirally wound to form the core. However, stacked cores and other core constructions may also be used. Preferred alloys are iron-based, because they tend to be suitable and relatively inexpensive. Particularly preferred are Fe-B-Si alloys, such as Metglas® alloy 2605 S-2 and similar alloys available from Allied Corporation, Morristown, N.J.

In order to accomplish magnetic annealing, a saturation field is applied to the core while it is immersed in a liquid whose temperature is preferably in the range between about 0.7 and 0.8 $T_g$. $T_g$ is the glass transition temperature of the alloy in °C. Generally, longer anneal times are required for lower anneal temperatures. Optimum results are achieved when annealing times are less than 30 minutes, more preferably less than 15 minutes, starting when the core center and core skin are both within about ±5% of the desired anneal temperature. For convenience, we refer to the average of the temperature at the core center and core skin as the "core temperature." Preferably, the temperature gradient through the core is minimized. Gradients cause differential thermal expansion between layers, which in turn causes relative motion that can lead to surface defects, telescoping, and other effects that degrade magnetic properties of the core. One way to minimize the temperature gradient is to insulate one or more exterior surface; i.e., a surface that would otherwise contact the liquid. The surface(s) to be insulated may be identified on the basis of the following:

A typical core shape is that of a right circular cylinder from which has been removed a smaller coaxial cylinder. If such a core is formed by winding ribbon in a spiral pattern, then thermal conductivity in the axial direction is substantially greater than in the radial direction, because the axial heat path is through the ribbon width, while the radial path is alternatively through the thicknesses of a conductive ribbon and an insulating inter-ribbon gap. Alternatively, if such a core is formed by stacking washer-shaped disks, then radial thermal conductivity is greater. To minimize thermal gradients during annealing, it is advantageous to insulate those surfaces that are otherwise exposed to the hot liquid (external surfaces) and from which the heat flow normal to the surface is slowest. Thus, in a wound core, the inner and outer cylindrical surfaces are insulated; in a stacked core, the top and bottom flat surfaces are insulated. In general, if a core has a direction in which the rate of heat flow is a minimum, then the sufaces to be insulated are any exterior surfaces that are substantially normal to that direction. of course the insulating material should withstand the hot liquid and not come off in the bath. The insulation may be removed after the annealing, but it needn't be.

After a core is annealed in a hot liquid, it is removed from the liquid and rapidly cooled by immersion in a cooling fluid. The cooling fluid can be selected from among those conventionally used, based on considerations such as heat capacity, boiling temperature, flammability, chemical inertness, etc. Suitable fluids include organic liquids, such as fluorocarbons and mixtures of dry ice with at least one liquid selected from the group consisting of acetone, methanol, and ethanol. Alternatively, the cooling fluid may comprise a liquefied gas, such as liquid nitrogen. A cooling gas may be used, but is generally not preferred, because cooling cannot be accomplished as rapidly as with a liquid. Preferably, a core is immersed in the cooling fluid until the inner windings reach a temperature of 200° C. or less. As with the annealing step, if the core floats in the cooling fluid it can be pushed under.

Depending on the compositions of the core and the hot liquid in which the core is immersed, some of the liquid may remain on the core after it is removed from the liquid bath. If the liquid is a molten metal, particularly if it is solid at ambient temperature, it can short circuit windings of the core. Windings that have been shorted can be removed; however, the problem is avoided if the core is coated before immersion in the hot liquid with a material, such as a dewetting material, that will eliminate adhesion of the liquid to the core. A suitable dewetting material is sold under the trademark Nicrobraz® by Wall Colmonoy Corp., Detroit, Mich. Alternatively, the core can be wrapped in a protective wrapper. The material of the protective wrapper is chosen to prevent the liquid from contacting the core, while minimizing thermal insulation of the core from the liquid. Of course, the materials must withstand thermal and chemical attack from the hot liquid. Suitable materials include fiberglass, polyimide film (e.g., Kapton® polyimide film), metal foil, etc.

Since the annealing method of the present invention does not degrade ductility as much as prior art methods, the core need not be in its final form before it is annealed. Instead, after a wound core has been heated and cooled as described above, it can be unwound and rewound into a second core. Preferably, the second core has the same configuration as the original core, since the windings tend, to a certain extent, to take a "set" when they are first annealed.

The following examples are presented in order to provide a more complete understanding of the invention. The specific techniques, conditions, materials, and reported data set forth to illustrate the principles and practice of the invention are exemplary and should not be construed as limiting the scope of the invention.

EXAMPLE 1

Figure 2:
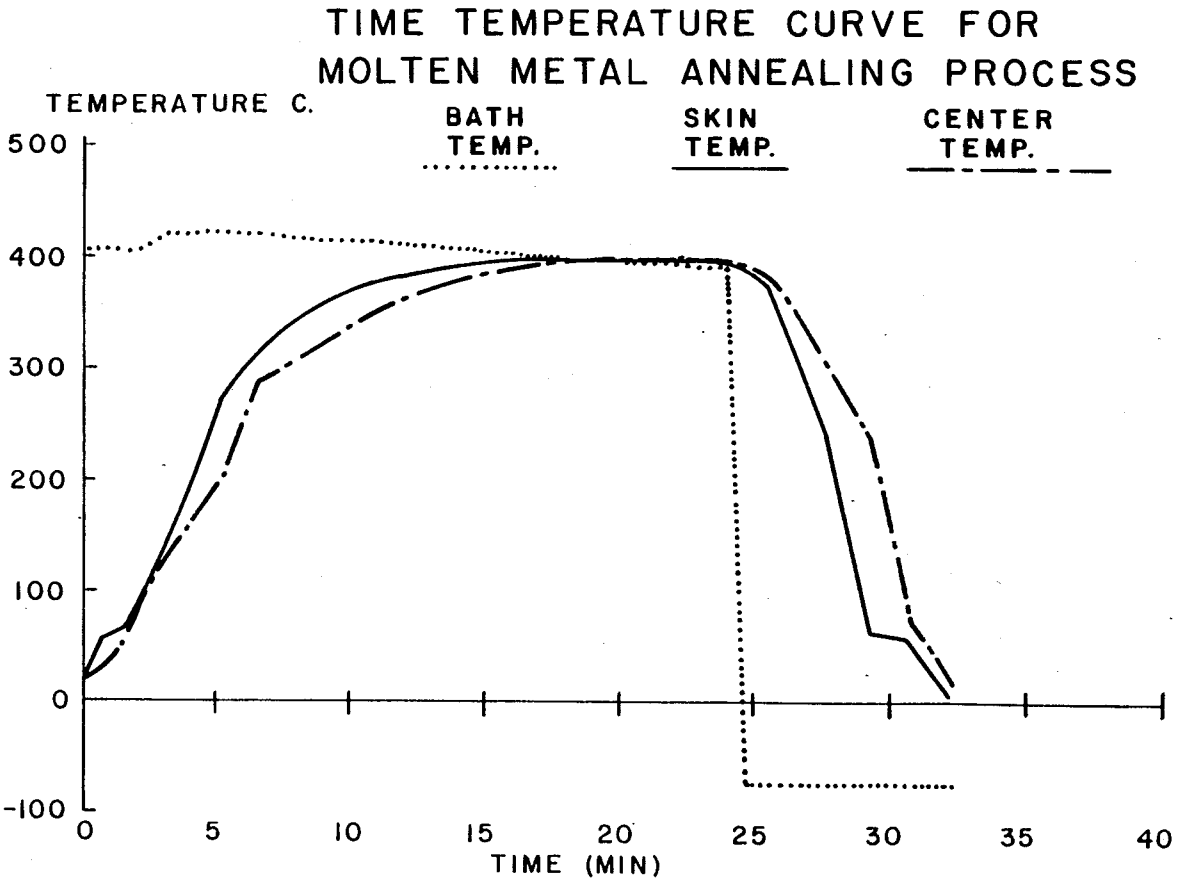
FIG. 2 is a graph of core and bath temperatures during annealing by the method of the present invention.

A core wound from amorphous ribbon of compositon $Fe_{78}B_{13}Si_9$, weighing 26 kg, was coated with Nicrobraz® dewetting agent and placed into a bath of molten tinbased solder at 400° C., as a saturation magnetic field was applied to the core. The temperatures of the bath, core skin, and core center were monitored with thermocouples and are plotted in FIG. 2. Starting with the time when all three temperatures were within about ±5% of the soak temperature, the core was held at that temperature for about 4–8 minutes. The core was then quickly removed from the bath and cooled to room temperature in a slurry of acetone/dry ice at −78° C. As can be seen from FIG. 2, the entire process takes just over 30 minutes.

EXAMPLE 2 (Prior Art)

Figure 3:
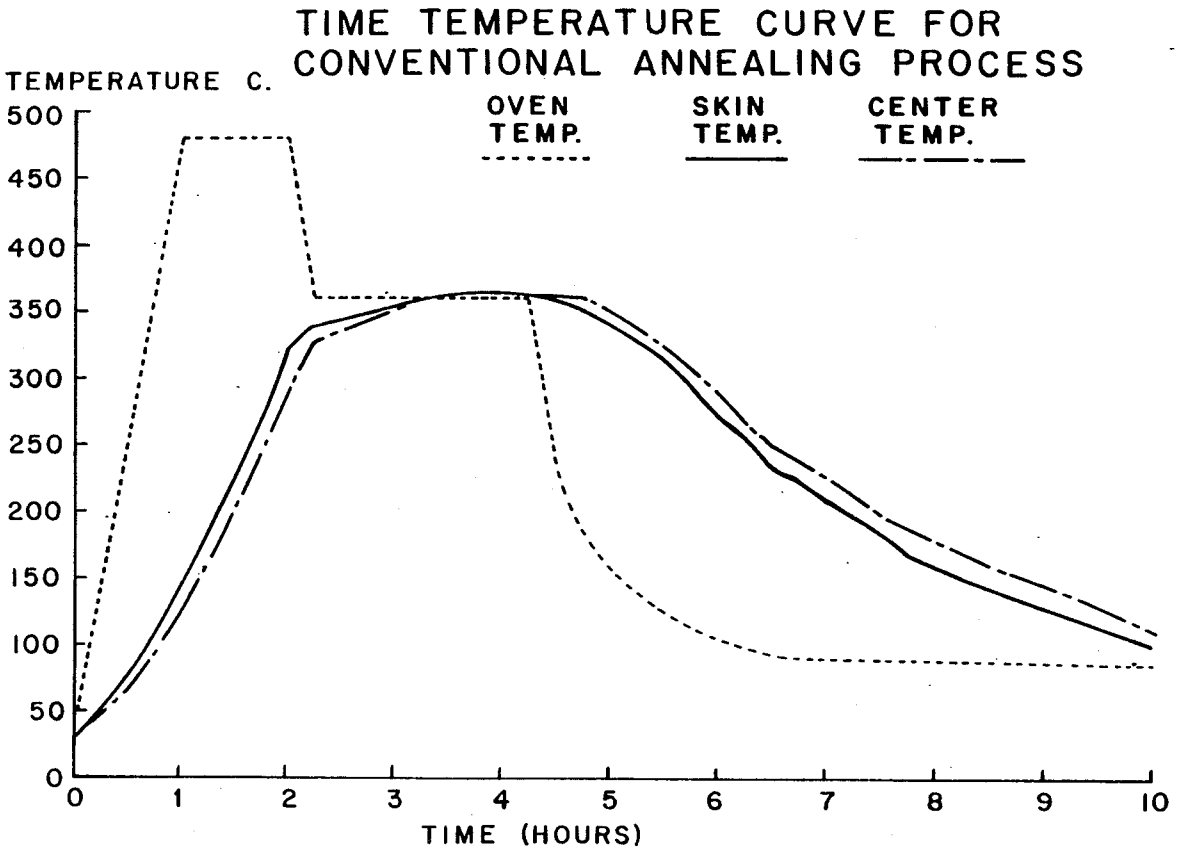
FIG. 3 (Prior Art)
FIG. 3 is a graph of core and oven temperatures during annealing by a prior art method.

The core of Example 1 was annealed in a conventional oven in a saturation magnetic field. The temperatures of the oven, core skin, and core center are plotted in FIG. 3. Note that times are in "hours," rather than "minutes," as in FIG. 2.

Table 1 below records results for 11 cores annealed by the prior art method of Example 1 and 11 cores annealed by the method of Example 2. We note that the cores annealed by the method of the present invention show equivalent magnetic properties, even though the annealing times were much shorter.

TABLE 1

| | CORE LOSSES @ 60 Hz, 1.4 Tesla. | | | |
|---|---|---|---|---|
| | MOLTEN METAL PROCESS | | CONVENTIONAL PROCESS | |
| | Core Loss (W/kg) | Exciting Power (VA/kg) | Core Loss (W/kg) | Exciting Power (VA/kg) |
| | 0.254 | 0.368 | 0.271 | 0.314 |
| | 0.249 | 0.377 | 0.239 | 0.277 |
| | 0.206 | 0.274 | 0.221 | 0.299 |
| | 0.274 | 0.450 | 0.240 | 0.491 |
| | 0.235 | 0.607 | 0.241 | 0.305 |
| | 0.243 | 0.398 | 0.212 | 0.444 |
| | 0.283 | 0.364 | 0.235 | 0.314 |
| | 0.253 | 0.318 | 0.202 | 0.767 |
| | 0.262 | 0.346 | 0.225 | 0.553 |
| | 0.287 | 0.363 | 0.235 | 0.271 |
| | 0.271 | 0.339 | 0.239 | 0.608 |
| x | 0.256 | 0.382 | 0.233 | 0.422 |
| $\sigma$ | 0.022 | 0.083 | 0.017 | 0.157 |

Table 2 presents the data that confirm that the shorter annealing times of the present invention yield cores having greater ductility. Cores annealed in molten metal by a method of the present invention were each unwound from their mandrel and rewound on another mandrel at 76 cm/s, using various tension levels. Conventionally annealed cores were also unwound and rewound. For a given line speed and tension level, ductile ribbon is less likely to break. Thus, the fact that conventionally annealed ribbon broke more frequently, even though the line speed and tension level were both smaller than for cores annealed in molten metal, shows that the latter cores are more ductile.

TABLE 2

| Core Size (kg) | Line Speed (cm/s) | Tension (kg/25 mm width) | # of Breaks |
|---|---|---|---|
| | DUCTILITY | | |
| | MOLTEN METAL PROCESS | | |
| 18 | 76 | 0.31 | 6 |
| 18 | 76 | 0.31 | 18 |
| 18 | 76 | 0.62 | 18 |
| 18 | 76 | 0.62 | 6 |
| 18 | 76 | 0.31 | 6 |
| 5 | 76 | 1.50 | 0 |
| | CONVENTIONAL PROCESS | | |
| 55 | 15-30 | 0.13 | >60 |
| 52 | 15-30 | 0.13 | >60 |
| 40 | 15-30 | 0.13 | >60 |

We claim:

1. A method for rapid magnetic annealing of an amorphous metal alloy core comprising the steps of (a) applying a magnetic field to the core, (b) immersing the core in a liquid comprising molten tin, whose temperature is in the range between about 0.6 $T_g$ and 1.0 $T_g$, where $T_g$ is the glass transition temperature of the alloy in degrees C., (c) separating the core from the liquid, and (d) immersing the core in a cooling fluid.

2. The method of claim 1 in which the temperature of the liquid is in the range between about 0.7 $T_g$ and 0.8 $T_g$.

3. The method of claim 1 in which the alloy comprises an iron-based alloy.

4. The method of claim 3 in which the alloy comprises an Fe-B-Si alloy.

5. The method of claim 1 in which the core temperature is maintained in the range between about 0.7 $T_g$ and 0.8 $T_g$ for a period of less than about 30 minutes.

6. The method of claim 5 in which the core temperature is maintained in the range between about 0.7 $T_g$ and 0.8 $T_g$ for less than about 15 minutes.

7. The method of claim 1 in which the cooling fluid comprises an organic liquid.

8. The method of claim 7 in which the cooling fluid comprises a fluorocarbon.

9. The method of claim 7 in which the cooling fluid comprises a mixture of dry ice and at least one liquid selected from the group consisting of acetone, methanol, and ethanol.

10. The method of claim 1 in which the cooling fluid comprises liquid nitrogen.

11. The method of claim 1 in which the core is immersed in the cooling fluid until the core temperature is about 200° C. or less.

12. The method of claim 1 further comprising the step of coating the core, before immersing it in the liquid, with a material that will reduce any tendency for the liquid to adhere to the core after the core has been separated from it.

13. The method of claim 12 in which the coating material comprises a dewetting material.

14. The method of claim 1 in which there is a direction in the core for which the rate of heat transfer is a minimum and any external surface that is normal to that direction is provided with thermal insulation before the core is immersed in the liquid.

15. The method of claim 1 in which the core is placed in a protective wrap before it is immersed in the liquid.

16. The method of claim 15 in which the wrap comprises a material selected from the group consisting of metal foil, fiberglass, and polyimide film.

17. The method of claim 1, in which the core has been wound from strip, further comprising, after step (d), unwinding the core and rewinding the strip into a second core.

* * * * *